US005566666A

United States Patent [19]

Sjödin

[11] Patent Number: 5,566,666

[45] Date of Patent: Oct. 22, 1996

[54] ROTATING TOOL

[76] Inventor: Sven-Eric Sjödin, Dalkärrsleden 37, S-162 24, Vällingby, Sweden

[21] Appl. No.: 256,940

[22] Filed: Jan. 30, 1995

[30] Foreign Application Priority Data

Jan. 29, 1992 [SE] Sweden ..... 9200240

[51] Int. Cl.[6] ..... B28D 1/00

[52] U.S. Cl. ..... 125/15; 451/484; 451/464; 29/81.05

[58] Field of Search ..... 125/5, 3, 15, 13.01, 125/11.03, 11.01, 37; 451/484, 464, 468, 541, 526; 144/15; 29/81.01, 81.05, 81.11, 81.12, 81.13, 81.021

[56] References Cited

U.S. PATENT DOCUMENTS

| | | | |
|---|---|---|---|
| 1,535,628 | 4/1925 | Peterson | 125/15 |
| 3,076,219 | 2/1963 | Peterson | 15/179 |
| 3,722,022 | 3/1973 | Falleson | 125/3 |
| 3,942,208 | 3/1976 | Southard, Jr. | 125/5 |
| 5,371,972 | 12/1994 | Mconkey et al. | 29/81.12 |

FOREIGN PATENT DOCUMENTS

| | | | |
|---|---|---|---|
| 412883 | 1/1974 | U.S.S.R. | 451/466 |

*Primary Examiner*—Robert A. Rose
*Attorney, Agent, or Firm*—Ronald J. Kubovcik

[57] ABSTRACT

A rotating tool includes e hub having a central section for attaching the hub to a rotatable shaft and a disc-shaped hub section surrounding the central section. The central section and the hub section are comprised of an elastomeric material and formed as a unitary body. A plurality of sleeves are embedded in the hub section with each sleeve having an end terminating in the hub section and an opposing end protruding from the hub section. The protruding ends are spaced around the circumference of the hub section. Working tips are fastened in the protruding end of each sleeve. Each working tip has a base disposed in the protruding end of the sleeve and a tip protruding from that end of the sleeve. In an alternative embodiments, the hub section has a plurality of projections in which the sleeves are embedded.

19 Claims, 2 Drawing Sheets

ROTATING TOOL

TECHNICAL FIELD

The present invention relates to a rotating tool, comprising a rotatably supported hub, around the circumference of which a number of working tip element are arranged.

More particularly, the rotating tool is of the type intended for the rough-finishing of surfaces, such as the removal of rust on steel plates, machining of welds before application of additional welt material, grinding of concrete surfaces, paint removal, etc.

STATE OF THE ART

As demonstrated by DE 2,652,716, FR 718,874, U.S. Pat. Nos. 1,633,274, 3,958,294, 4,183,113, and PCT/SE86/00307, a number of rotating tools are known. These rotating tools have their working tip elements situated at the ends of more or less elastic metal wires which are attached to the hub. A serious disadvantage with these tools is, besides in many cases poor material removal capacity and limited resistance against wear, that the wires break so that wire pieces can be thrown off with great force, with the accompanying risk for personal injuries.

STATEMENT OF THE INVENTION

The object of the present invention is to provide a rotating tool, which in comparison to the state of the art has a very large material removal capacity and has its working tip elements fastened in such a way that there exists very little risk that pieces of metal shall be able to come loose and be thrown off in operation.

This object has been achieved for a rotating tool of the kind defined by way of introduction, according to the invention, in that the hub consists of at least one essentially disc shaped, elastic, and in the axial direction elastically deflectable hub section, and that the working tip elements are located in the ends of pin-like holders which are imbedded in the hub section in a way to be able to follow deflections of the disc shaped hub-section under load.

Preferably the holders are applied in the hub section by injection molding of the latter.

According to an advantageous embodiment the holders consist of sleeves, in the outer end of which the working tip element is fastened, allowing for the sleeves to be applied in the hub section by injection molding of the latter such that its material also penetrates into the sleeves.

According to a further advantageous embodiment the sleeves have a longitudinally extending slit, which allows for the working tip elements to be fastened in the end of the respective sleeve by means of a solder metal piece applied in the slit.

Alternatively the working tip elements may be fastened in the end of the respective sleeves by clamping which, according to a very advantageous embodiment, is obtained by locating the working tip elements in a countersink in the end of the respective sleeves, and fastening them therein by clamping the wall of the countersink into engagement with the side of the working tip element. The clamping effect is, according to a preferred embodiment, enhanced if the working tip elements have a conical shape and rest with their base end on the bottom of the countersink.

A tool with very advantageous operational qualities is obtained if, according to a further embodiment, the disc shaped hub section has peripheral recesses between the working tip elements to leave tooth-like portions of the disc material in which the working tip elements are imbedded.

In still a further embodiment the tool according to the invention may comprise at least two disc shaped hub sections attached on the same shaft.

DESCRIPTION OF THE DRAWINGS

The invention shall now be described in more detail below with reference to the attached drawings of which FIG. 1 in a plane view, partly broken away, shows a first embodiment of a rotating tool according to the invention.

DESCRIPTION OF EMBODIMENTS

Figure 1:
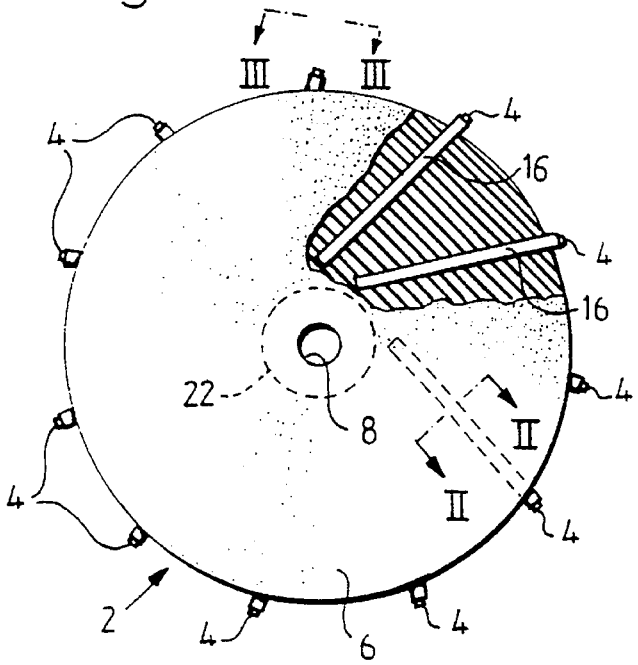

The rotating tool comprises, in a first embodiment shown in FIG. 1, a rotatably supported hub 2, around the circumference of which a number of working tip elements 4 made of, e.g. hard metal, are arranged as described in more detail below. The hub comprises a round, essentially disc shaped hub section 6, which consists of a deflectable and elastic material, e.g., an elastomer.

The hub disc 6 has a central hole 8 by means of which it is brought onto a rotatable shaft 10 on which it is rigidly affixed in a suitable way, e.g. fixedly fastened by means of nuts 12 between two rigid supporting washers 14 of metal. The shaft 10 can be intended to be rotatably driven by means of a hand machine, not shown, e.g., a conventional drill, in the chuck of which the shaft 10 is fastened.

Figure 2:
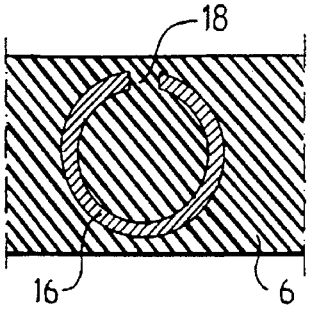
FIG. 2 shows a section of the same tool in the direction of arrows II—II in FIG. 1.

The working tip elements 4 are in the form of short pins each held at the end of pin-like holders 16, which are embedded in an essentially spoke-like pattern in the hub disc 6 in the way illustrated by FIGS. 1 and 2. The working tip elements 4 and their respective holders 16 will also be referred to below as working tip units 4, 16.

Figure 3:
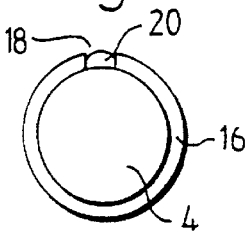
FIG. 3 shows an end view in the direction of arrows III—III in FIG. 1 of a working tip forming a part of the tool.

FIG. 3 illustrates how, in a first embodiment of the working tip units, the working tip elements 4 may be in the form of short pins each soldered in the free end of a sleeve forming the respective pin-like holder 16 and having a longitudinally extending slit 18. More particularly, the tip elements 4 are fastened in the ends of their respective sleeves 16 by a solder metal piece 20 applied in the slit 18 of the sleeve.

Figure 4:
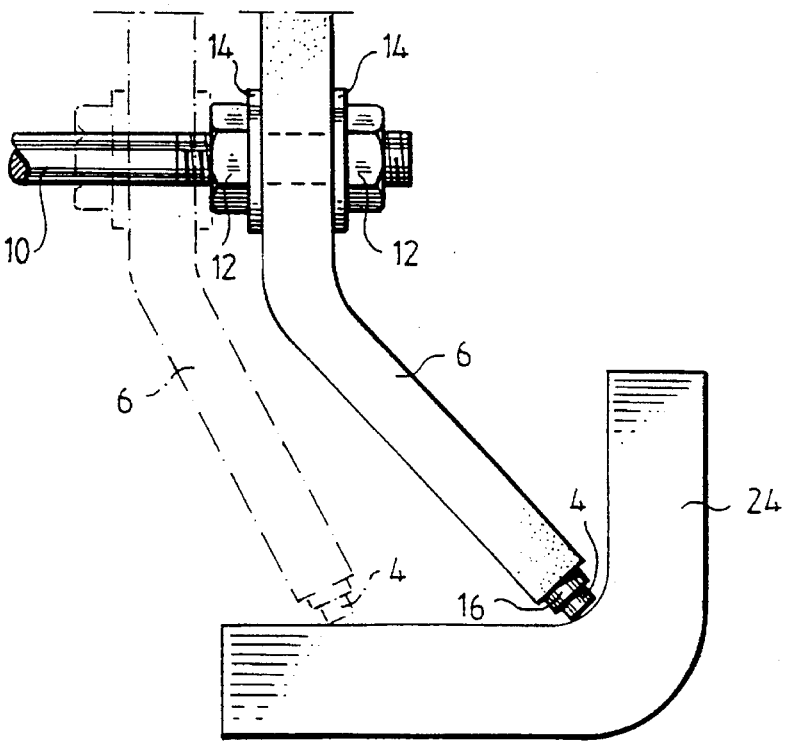
FIG. 4 shows a perspective view of the tool in order to illustrate the automatic adaption of the tool'shape to an example of use during operation, FIG. 5 in a plane view shows a second embodiment of a rotating tool according the the invention.

The sleeves 16 protrude outside the circumference of the hub disc 6 by a short part of their length, which may approximately correspond to the length of the working tip 4. The length of the sleeves 16 may not be such that their inner ends become clamped between the supporting washers 14, the outer circumference of which being indicated in FIG. 1 by a dashed line 22. The sleeves are thus not rigidly affixed with respect to the shaft 10, but allow and can follow bending of the hub disc 6 caused by such use of the tool as demonstrated in FIG. 4. In FIG. 4 the tool is used, as seen, for working the surface of an angled workpiece 24, the hub disc being deflected under the influence of the applied force.

The pin-like holders 16 with mounted hard metal tip elements 4 are imbedded in the hub disc 6 upon injection molding of the latter. In the case of the holders 16 being slitted sleeves as in FIGS. 2 and 3, the material of the hub disc will fill the interior of the sleeves during the injection moulding, as indicated by FIG. 2, the longitudinal slits 18 then also providing for easy escape of air from the interior of the sleeves when filled. This leads to a very safe attachment of the sleeves, which practically precludes their breakage in a way that carries risk for throwing off pieces during operation. The attachment is in fact strengthened additionally during operation by the radial extension of the elastic disc 6 caused by centrifugal force and the thinning of the disc caused thereby, which in turn causes clamping of the disk's material essentially in the axial direction onto the sleeves.

Figure 5:
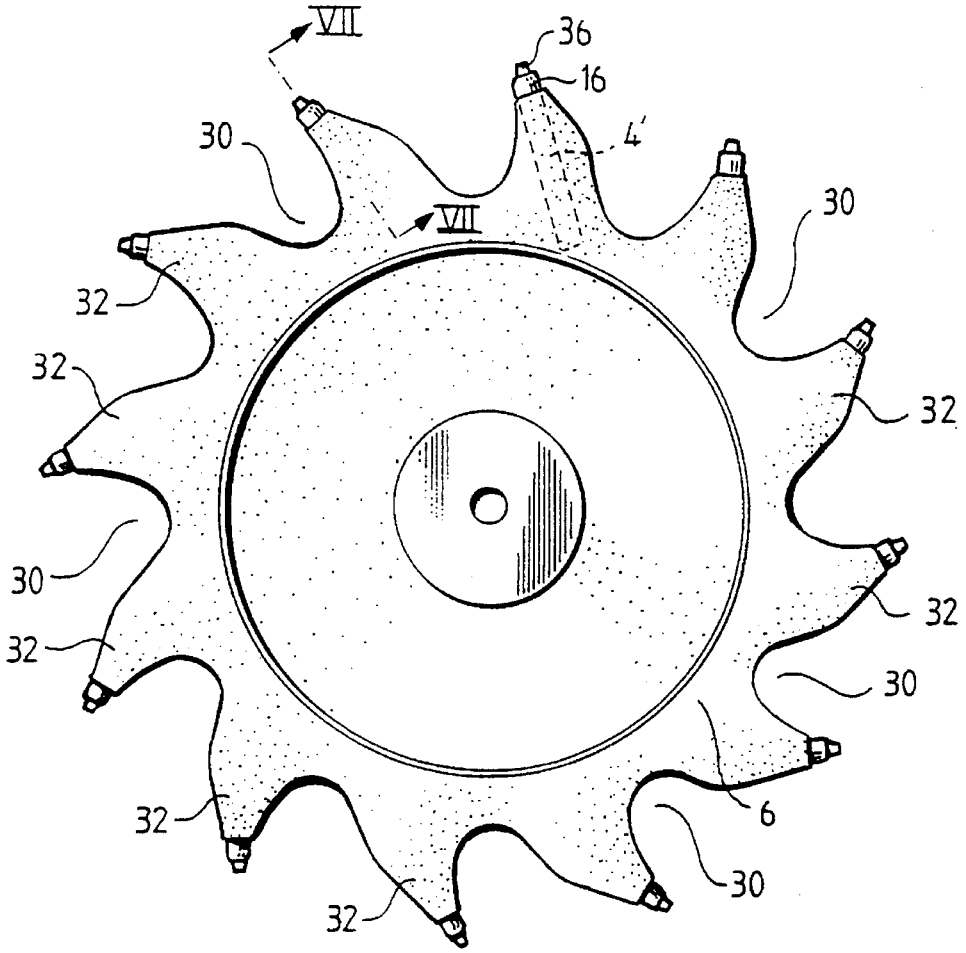

FIG. 5 illustrates a second embodiment of the tool according to the invention. In this Figure similar or similarly acting elements as in the preceeding Figures have been given the same reference characters.

In FIG. 5 the disc shaped hub section 6 has peripheral recesses 30 between the working tip elements 4 to leave tooth-like portions 32 of the disc material in which the working tip units 4, 16 are imbedded. This arrangement has turned out in practice to result in strengthened peripherally directed vibrations of each working tip 4 when the tool rotates, as well as short movements in the length direction of the working tip units. This in turn results in each working tip hitting the surface of the work piece a limited number of times for each revolution of the tool typically of an order of magnitude of 4 in a practical case. A similar phenomenon is also obtainable to a limited extent in the embodiment according to FIG. 1.

The above described action has, particularly for the embodiment according to FIG. 5, turned out in practice to greatly improve the operational result obtainable with a tool according to the invention.

Figure 6:
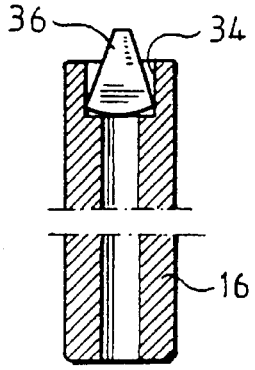
FIG. 6 shows an enlarged section in the direction of arrows VI—VI in FIG. 5 to illustrate one step during the manufacture of working tip units included in the tool, and FIG. 7 in a similar section illustrates a following step.
Figure 7:
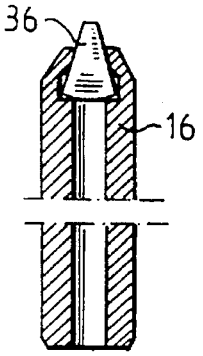

FIGS. 6 and 7 illustrate two steps during the manufacture of a second embodiment of the working tip unit 4, 16, which may be alternatively used in the embodiment in FIG. 5. The pin-like holder 16 is also here in the form of a sleeve, although not slitted. In one end this sleeve 16 has a countersink 34 for receiving the working tip element 4, which here tapers conically towards the working tip 36 proper.

FIG. 6 illustrates a situation where the working tip element 4 has been put in place in the countersink 34 but not affixed therein. In a next step the peripheral wall of the countersink is clamped towards the conical surface of the working tip element 4. This results in the situation shown in FIG. 7, where the countersink wall keeps the element 4 steadily trapped by virtue of the engagement between the countersink wall and the conical surface of the element 4. Although having turned out in practice to be completely safe for keeping the working tip element 4 against loosening in operation, this engagement nevertheless allows easy escape of air via the countersink 34 in connection with filling the interior of the sleeve 16 with molding material during embedding of the working tip units by injection molding.

In one practical realization of the tool according to the invention, corresponding to the embodiment according to FIGS. 5–7, the sleeve 16 has a length of 33 mm, and the working tip element 4 a length of 5,8 mm. The top and base diameters of the element 4 are 1,8 mm and 2,5 mm, respectively. The relative dimensions of the working tip element and the disc 6 appear from a comparison between the length of the unit 4' indicated with dashed lines and the diameter of the disc 6.

For certain fields of application it may be advantageous to fasten two or more hub discs 6 on the same shaft 10, as is indicated with dashed lines in FIG. 4, so that one obtains a working tool having greater extension in the axial direction. These hub discs do not need, contrary to what is indicated in FIG. 4, to be placed at a distance from each other, but can be placed on the shaft side-to-side between two shared holding washers 14.

I claim:

1. A rotating tool, comprising:

a hub having a central section for attaching said hub to a rotatable shaft and a disc-shaped hub section surrounding said central section, said central section and said hub section being comprised of an elastomeric material and formed as a unitary body;

a plurality of sleeves embedded in said hub section, each sleeve having an end terminating in said hub section and an opposing end protruding from said hub section, the protruding ends being spaced around a circumference of said hub section; and working tips fastened in the protruding end of each sleeve, each working tip having a base disposed in the protruding end of the sleeve and a tip protruding from said end of the sleeve.

2. The rotating tool of claim 1, wherein the protruding end of each sleeve has a longitudinal slit therein and the working tips are metal tips, said tips being fastened in said end of each sleeve by means of solder applied in said slit.

3. The rotating tool of claim 1, wherein the protruding end of each sleeve has a countersink defining a peripheral wall and the working tips are metal tips, said tips being fastened in each countersink by clamping said wall into engagement with each tip.

4. The rotating tool of claim 3, wherein the metal tips have a conical shape and are disposed in each countersink so that said base of each metal tip rests on a bottom surface of each countersink.

5. The rotating tool of claim 1, wherein the sleeves are embedded in the disc-shaped hub section of the hub by forming the hub around the sleeves by injection molding.

6. The rotating tool of claim 5, wherein the sleeves having longitudinal slits therein so that the interior of each sleeve is filled during injection molding of the hub.

7. The rotating tool of claim 1, wherein peripheral recesses are provided in the disc-shaped hub section between the working tips.

8. The rotating tool of claim 3, wherein the sleeves are embedded in the disc-shaped hub section of the hub by forming the hub around the sleeves by injection molding.

9. The rotating tool of claim 8, wherein the sleeves have longitudinal slits therein so that the interior of each sleeve is filled during injection molding of the hub.

10. The rotating tool of claim 2, wherein the sleeves are embedded in the disc-shaped hub section of the hub by forming the hub around the sleeves by injection molding.

11. The rotating tool of claim 10, wherein the sleeves have longitudinal slits therein so that the interior of each sleeve is filled during injection molding of the hub.

12. A rotating tool, comprising:

a hub having a central section for attaching said hub to a rotatable shaft and a hub section having a plurality of projections surrounding said central section, said central section and said hub section being comprised of an elastomeric material and formed as a unitary body;

a plurality of sleeves embedded in said projections of said hub section, each sleeve having an end terminating in said hub section and an opposing end protruding from said projection; and working tips fastened in the protruding end of each sleeve, each working tip having a base disposed in the protruding end of the sleeve and a tip protruding from said end of the sleeve.

13. The rotating tool of claim 12, wherein the protruding end of each sleeve has a longitudinal slit therein and the working tips are metal tips, said tips being fastened in said end of each sleeve by means of solder applied in said slit.

14. The rotating tool of claim 12, wherein the protruding end of each sleeve has a countersink defining a peripheral wall and the working tips are metal tips, said tips being fastened in each countersink by clamping said wall into engagement with each tip.

15. The rotating tool of claim 14, wherein the metal tips have a conical shape and are disposed in each countersink so that said base of each metal tip rests on a bottom surface of each countersink.

16. The rotating tool of claim 12, wherein the sleeves are embedded in the projections of the hub section of the hub by forming the hub around the sleeves by injection molding.

17. The rotating tool of claim 16 wherein the sleeves have longitudinal slits therein so that the interior of each sleeve is filled during injection molding of the hub.

18. The rotating tool of claim 14 wherein the sleeves are embedded in the projections of the hub section of the hub by forming the hub around the sleeves by injection molding.

19. The rotating tool of claim 18, wherein the sleeves have longitudinal slits therein so that the interior of each sleeve is filled during injection molding of the hub.

* * * * *

UNITED STATES PATENT AND TRADEMARK OFFICE

CERTIFICATE OF CORRECTION

PATENT NO. : 5,566,666

DATED : October 22, 1996

INVENTOR(S) : Sven-Erik SJÖDIN

It is certified that error appears in the above-indentified patent and that said Letters Patent is hereby corrected as shown below:

IN THE COVER PAGE,

Item: [22] in its entirety and replace with the following boxes [22], [86] and [87]:

--[22] PCT filed: January 29, 1993

[86] PCT No.: PCT/SE93/00064

§ 371 Date: January 30, 1995

§ 102(e) Date: January 30, 1995

[87] PCT Pub. No.: WO 93/14685

PCT Pub. Date: August 5, 1993 --.

Signed and Sealed this

Seventh Day of January, 1997

Bruce Lehman

*Attest:*

BRUCE LEHMAN

*Attesting Officer*

*Commissioner of Patents and Trademarks*